US008421553B2

(12) United States Patent
Mukaiyama

(10) Patent No.: US 8,421,553 B2
(45) Date of Patent: Apr. 16, 2013

(54) DIRECTIONAL COUPLER

(75) Inventor: Kazutaka Mukaiyama, Kyoto-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 13/586,788

(22) Filed: Aug. 15, 2012

(65) Prior Publication Data

US 2012/0306589 A1 Dec. 6, 2012

(30) Foreign Application Priority Data

Feb. 19, 2010 (JP) ..... 2010-034438

(51) Int. Cl.
*H01P 5/12* (2006.01)
*H01P 1/22* (2006.01)

(52) U.S. Cl.
USPC ..... 333/116; 333/109

(58) Field of Classification Search ..... 333/109, 333/110, 112, 116, 81 R
See application file for complete search history.

(56) References Cited

U.S. PATENT DOCUMENTS 4,482,873 A * 11/1984 Nyhus ..... 333/116
7,218,186 B2 * 5/2007 Chen ..... 333/116
7,961,064 B2 * 6/2011 Kearns et al. ..... 333/109
2009/0237176 A1 9/2009 Endo

FOREIGN PATENT DOCUMENTS

JP 53-050645 A 5/1978
JP 60-120601 A 6/1985
JP 2009-044303 A 2/2009
JP 2009-260288 A 11/2009

OTHER PUBLICATIONS

International Search Report; PCT/JP2011/051276; Apr. 26, 2011.

* cited by examiner

*Primary Examiner* — Dean O Takaoka
(74) *Attorney, Agent, or Firm* — Studebaker & Brackett PC; Tim L. Brackett, Jr.; John F. Guay

(57) ABSTRACT

The disclosure provides a directional coupler having favorable characteristics even when a parasite inductance is present on a coupling line. The directional coupler includes resistive elements between at least either a signal input port and a coupling port or between a signal output port and an isolation port. The resistive elements can reduce the output from the ISO port and improve directivity.

11 Claims, 10 Drawing Sheets

FIG.1A
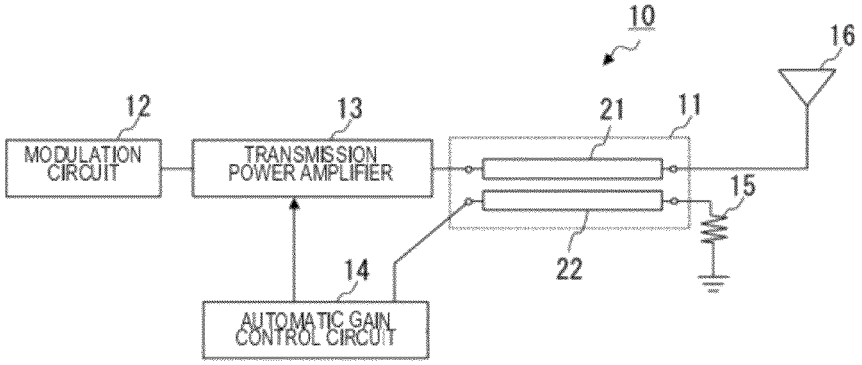
FIG.1B
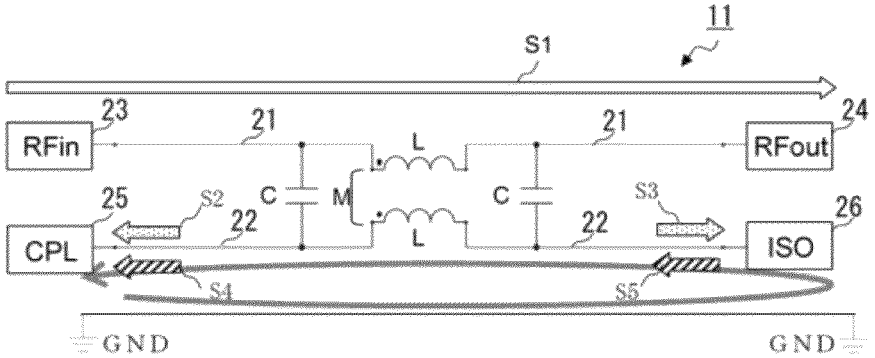
FIG.1C
| | CPL PORT | ISO PORT |
|---|---|---|
| ELCECTRICAL COUPLING | PHASE OF +90° WITH RESPECT TO S1 ← S2 | PHASE OF +90° WITH RESPECT TO S1 → S3 |
| MAGNETIC COUPLING | PHASE OF +90° WITH RESPECT TO S1 (MAGNETIC COUPLING (-90°) + DIRECTION OF LOOP (+180°)) ← S4 | PHASE OF -90° WITH RESPECT TO S1 (MAGNETIC COUPLING) ← S5 |
| SUM OF COUPLING | ← S2 ← S4 | 0 |

(B)

DIRECTIONAL COUPLER

CROSS REFERENCE TO RELATED APPLICATIONS

The present application claims priority to International Application No. PCT/JP2011/051276 filed on Jan. 25, 2011, and to Japanese Patent Application No. 2010-034438 filed on Feb. 19, 2010, the entire contents of each of these applications being incorporated herein by reference in their entirety.

TECHNICAL FIELD

The technical field relates to a directional coupler, and in particular, relates to improvement in the characteristic of a transmission line directional coupler.

BACKGROUND

FIG. 1A is a block diagram of an RF transmitter circuit including a transmission line directional coupler. FIG. 1B is an ideal equivalent circuit diagram of the directional coupler. FIG. 1C is a diagram showing directions of signals at a coupling port and an isolation port of the directional coupler shown in FIG. 1B. FIG. 2A is a diagram showing an output signal from the coupling port of the directional coupler in polar coordinate form. FIG. 2B is a diagram showing an output signal from the isolation port of the directional coupler in polar coordinate form. FIG. 2C is a diagram showing both of the output signals from the coupling port and the isolation port of the directional coupler in polar coordinate form.

In the related art, a directional coupler is used for usage applications such as monitoring the power of a radio-frequency signal, monitoring and stabilizing a radio-frequency signal source, and measuring transmission and reflection of a radio-frequency signal. For example, a configuration is known in which, as shown in FIG. 1A, in the RF transmitter circuit 10 for a cellular phone device or the like, an automatic gain control circuit 14 detects output power from a directional coupler 11 and controls a transmission power amplifier 13 in accordance with the detection value to make minimum necessary power of the input power from the transmission power amplifier 13 to the directional coupler 11.

A transmission line directional coupler utilizes electric field coupling and magnetic field coupling between a main line and a coupling line (sub line). As shown in FIG. 1B, when a signal S1 is inputted into a signal input port (RFin) 23, the signal S1 is outputted from a signal output port (RFout) 24 via a main line 21. At that time, the main line 21 and the coupling line 22 are coupled to each other with electric field coupling by a distributed capacitance C between both lines and are coupled to each other with magnetic field coupling by a mutual inductance M. In the coupling line 22, due to the electric field coupling, a signal S2 propagates in the direction to a coupling port (hereinafter, referred to as CPL port) 25 and a signal S3 propagates in a direction toward an isolation port (hereinafter, referred to as ISO port) 26. In addition, in the coupling line 22, due to the magnetic field coupling, a signal S4 and a signal S5 propagate in a direction toward the CPL port 25 in a closed loop including a ground (GND).

As shown in FIG. 1C, in the CPL port 25, the phase of the signal S2 is +90° with respect to the phase of the signal S1. Meanwhile, the phase of the signal S4 in the CPL port 25 is +90° with respect to the phase of the signal S1 due to a phase delay (−90°) and the direction of the loop (+180°). In other words, the phases of the signal S2 and the signal S4 coincide with each other, and thus a signal obtained by combining the powers of the two signals is outputted from the CPL port 25. When the signal S2 and the signal S4 are shown in polar coordinate form, they are as shown in FIG. 2A.

As shown in FIG. 1C, the phase of the signal S3 at the ISO port 26 is +90° with respect to the phase of the signal S1. Meanwhile, the phase of the signal S5 at the ISO port 26 is −90° with respect to the phase of the signal S1. In other words, the signal S3 and the signal S5 are opposite to each other in phase, and thus the two signals cancel each other, and no signal is outputted from the ISO port 26. When the signal S3 and the signal S5 are shown in polar coordinate form, they are as shown in FIG. 2B.

When the output signal (S2+S4) from the CPL port 25 shown in FIG. 2A and the output signal (S3+S5) from the ISO port 26 shown in FIG. 2B are collectively shown in polar coordinate form, they are as shown in FIG. 2C. In other words, the isolation (the output from the ISO port) is zero, and a high directivity (ratio of a coupling amount and isolation) is obtained.

It is noted that such a characteristic can be realized by adjusting the distributed capacitance and the mutual inductance M between the main line 21 and the coupling line 22. In addition, the directional coupler shown in FIG. 1B has an ideal equivalent circuit, and the coupling coefficient K for the mutual inductance M between the main line 21 and the coupling line 22 is 1.

FIG. 3A is a circuit diagram of a directional coupler (an attenuator composite coupler) which is described in Japanese Unexamined Patent Application Publication No. 2009-044303 (Patent Document 1) and in which attenuators are provided at both ends of a coupling line. FIG. 3B is an ideal equivalent circuit diagram of the attenuator composite coupler. FIG. 4A is a frequency characteristic diagram of the attenuator composite coupler shown in FIG. 3B. FIG. 4B is a diagram showing, in polar coordinate form, frequency characteristics of a coupling amount and an isolation of the attenuator composite coupler shown in FIG. 3B.

In the related art, a directional coupler (attenuator composite coupler) 30 is proposed in which, in order to suppress characteristic variation caused by a load connected to the outside, attenuators 31 and 32 are provided at both ends of a coupling line, namely, between a CPL port 35 and a coupling line 22 and between an ISO port 36 and the coupling line 22 as shown in FIG. 3A (see Patent Document 1). The equivalent circuit of the attenuator composite coupler 30 is as shown in FIG. 3B. The attenuator composite coupler 30 has frequency characteristics as shown in FIG. 4A. It is noted that in this figure, isolation is indicated as IS, reflection loss is indicated as RL, coupling amount is indicated as CP, insertion loss is indicated as IL, and directivity is indicated as D. In addition, as shown in FIG. 4B, the isolation (IS) is nearly zero and a high directivity is obtained.

SUMMARY

This disclosure provides a directional coupler from which a favorable isolation characteristic can be obtained even when a parasitic inductance is present in a coupling line.

In an embodiment according to the disclosure, a transmission line directional coupler includes a main line connected between a signal input port and a signal output port, and a coupling line connected between a coupling port and an isolation port and coupled to the main line by electric field coupling and magnetic field coupling. A resistive element is connected at least either between the signal input port and the coupling port or between the signal output port and the isolation port.

In a more specific embodiment, the resistive element may cancel or substantially cancel a real number component of a signal that is outputted to the isolation port due to parasite inductances of the coupling line and a circuit connected to the coupling line.

In another more specific embodiment, the directional coupler may further include a semi-insulating substrate on which the main line, the coupling line, and the resistive element are formed.

In yet another more specific embodiment, in the directional coupler, the main line, the coupling line, and the resistive element may be formed on the semi-insulating substrate by a thin-film process. When the directional coupler is manufactured by the thin-film process, position variation of each component can be suppressed and thus variation of the electrical characteristic of the directional coupler is reduced to be very small.

In another more specific embodiment of the directional coupler, a resistor attenuator may be connected at least either between the coupling port and the coupling line or between the isolation port and the coupling line, and a resistor of the resistor attenuator is formed on the semi-insulating substrate by the same process as for the resistive element.

BRIEF DESCRIPTION OF DRAWINGS

FIG. 1A is a block diagram of an RF transmitter circuit including a transmission line directional coupler; FIG. 1B is an ideal equivalent circuit diagram of the directional coupler; and FIG. 1C is a diagram showing the directions of signals at a coupling port and an isolation port of the directional coupler shown in FIG. 1B.

DETAILED DESCRIPTION

Figure 2A:
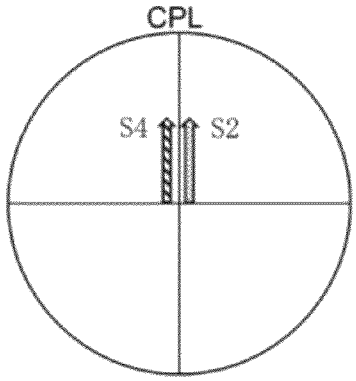
FIG. 2A is a diagram showing an output signal from the coupling port of the directional coupler in polar coordinate form.
Figure 2B:
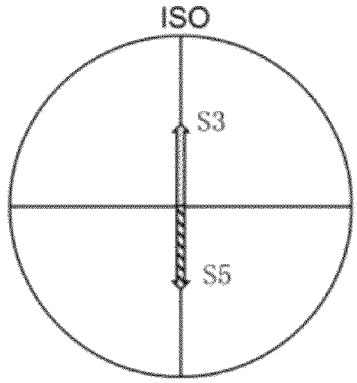
FIG. 2B is a diagram showing an output signal from the isolation port of the directional coupler in polar coordinate form.
Figure 2C:
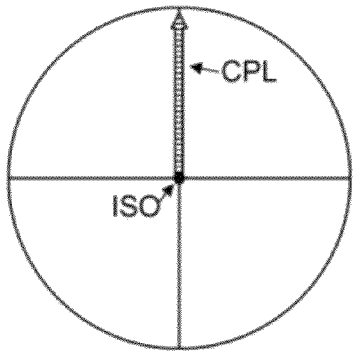
FIG. 2C is a diagram showing both of the output signals from the coupling port and the isolation port of the directional coupler in polar coordinate form.
Figure 3A:
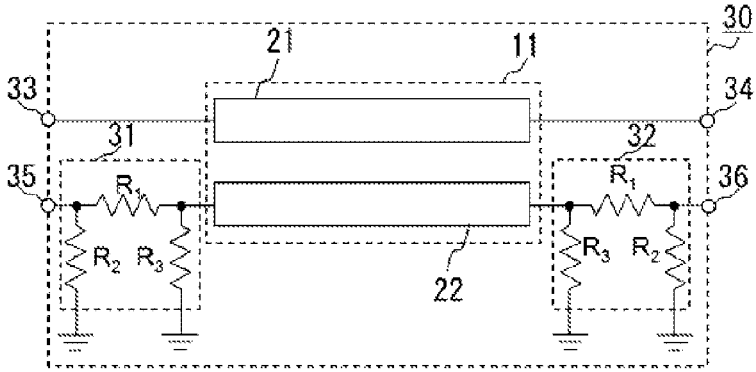
FIG.3A Prior Art
FIG. 3A is a circuit diagram of a directional coupler (attenuator composite coupler) which is described in Patent Document 1 and in which attenuators are provided at both ends of a coupling line.
Figure 3B:
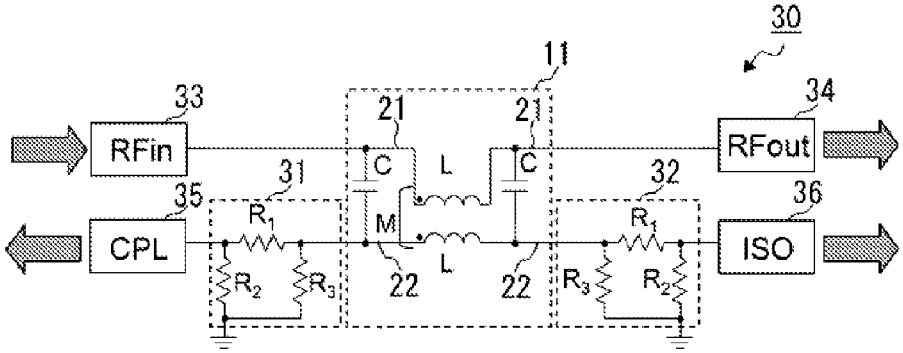
FIG. 3B is an ideal equivalent circuit diagram of the attenuator composite coupler.
Figure 4A:
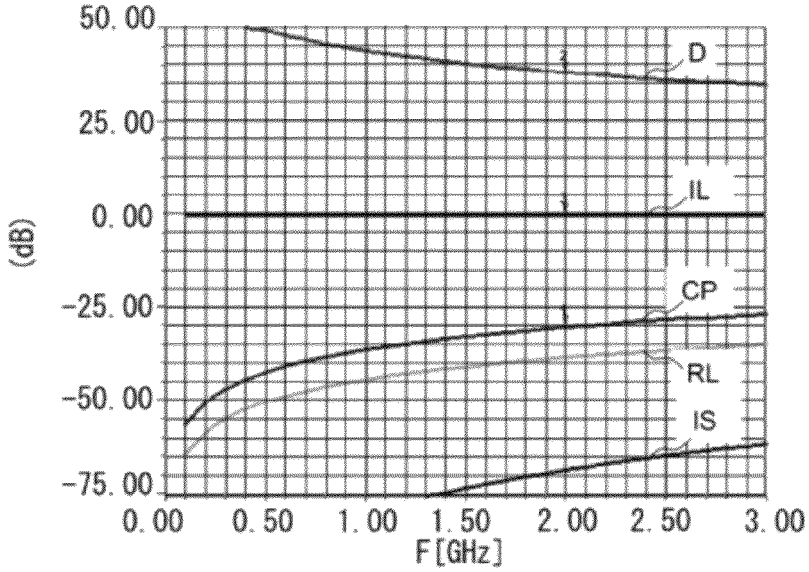
FIG. 4A is a frequency characteristic diagram of the attenuator composite coupler shown in FIG. 3B.
Figure 4B:
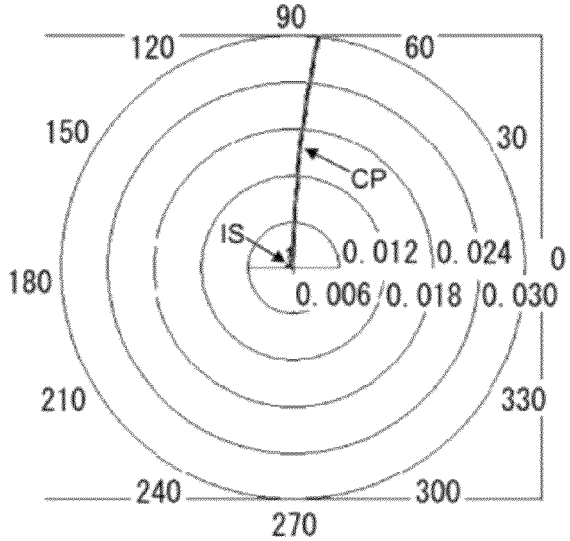
FIG. 4B is a diagram showing, in polar coordinate form, frequency characteristics of a coupling amount and an isolation of the attenuator composite coupler shown in FIG. 3B.
Figure 5A:
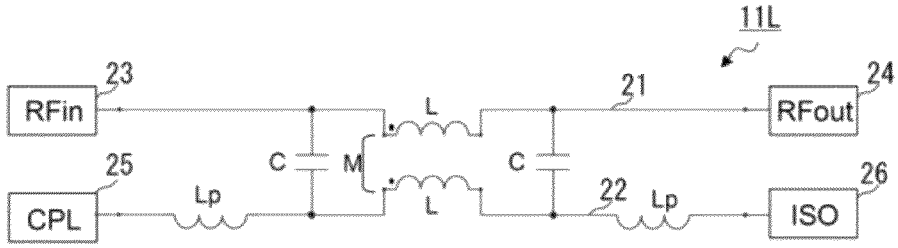
FIG. 5A is an equivalent circuit diagram of an actually created directional coupler.
Figure 5B:
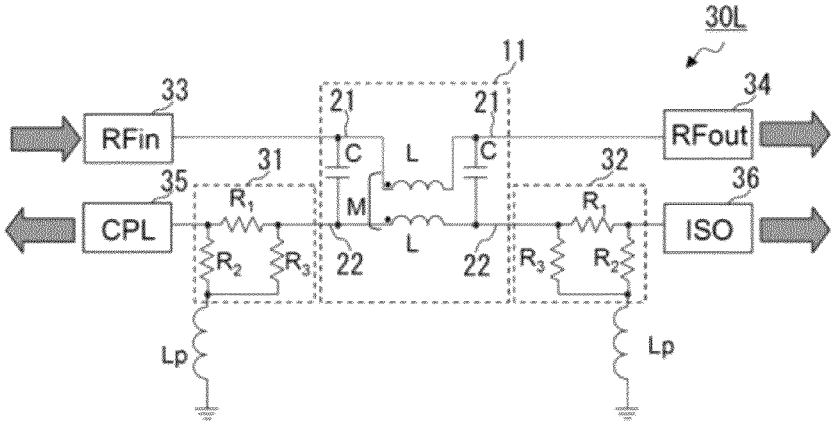
FIG. 5B is an equivalent circuit diagram of the actually created attenuator composite coupler.
Figure 6:
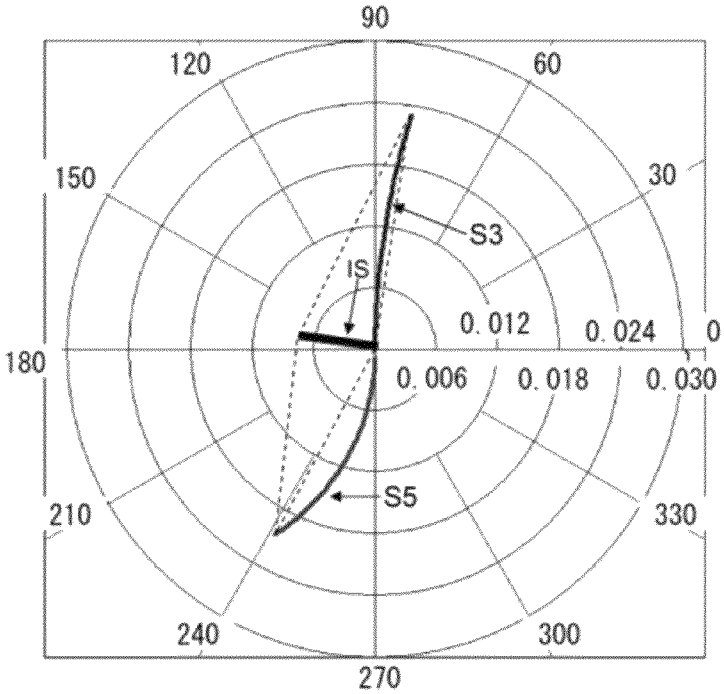
FIG. 6 is a diagram showing, in polar coordinate form, output from an ISO port of the directional coupler shown in FIG. 5A.
Figure 7A:
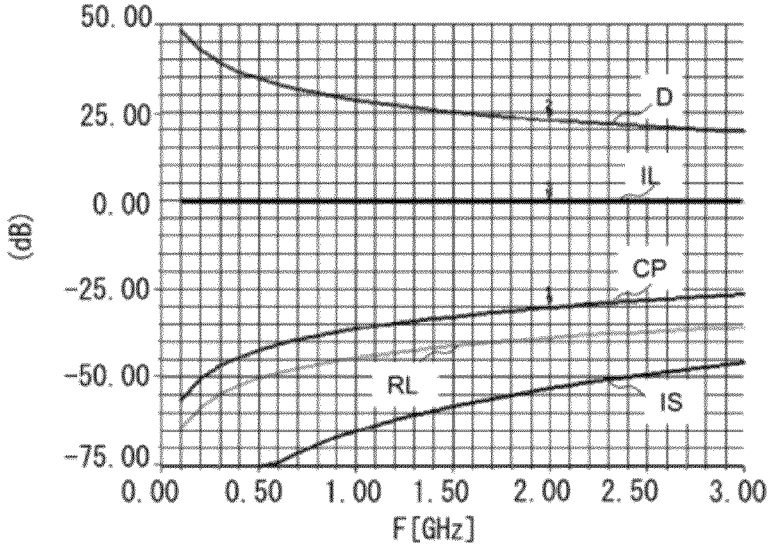
FIG. 7A is a frequency characteristic diagram of the attenuator composite coupler shown in FIG. 5B.
Figure 7B:
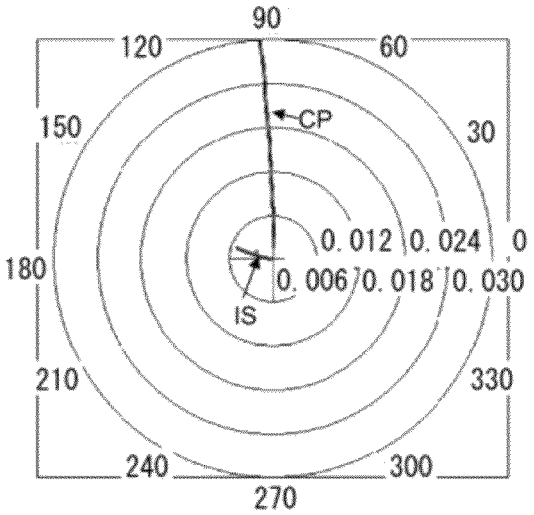
FIG. 7B is a diagram showing, in polar coordinate form, frequency characteristics of a coupling amount and an isolation of the attenuator composite coupler shown in FIG. 5B.

The inventor realized the following with respect to the directional coupler of the related art. FIG. 5A is an equivalent circuit diagram of an actually manufactured directional coupler. FIG. 5B is an equivalent circuit diagram of an actually manufactured attenuator composite coupler. FIG. 6 is a diagram showing, in polar coordinate form, output from an ISO port of the directional coupler shown in FIG. 5A. FIG. 7A is a frequency characteristic diagram of the attenuator composite coupler shown in FIG. 5B. It is noted that in this figure, the same indication as FIG. 4A is given. FIG. 7B is a diagram showing, in polar coordinate form, frequency characteristics of a coupling amount and an isolation of the attenuator composite coupler shown in FIG. 5B.

In the actually manufactured directional coupler, it is difficult to set the coupling coefficient K for the mutual inductance M to be 1 as in the ideal equivalent circuit shown in FIG. 1B. In addition, an inductance component is normally present in a wire. Thus, as shown in FIG. 5A, in the actually manufactured directional coupler 11L, parasite inductances Lp are present in the coupling line 22.

In this case, the signal S3 by the electric field coupling and the signal S5 by the magnetic field coupling (see FIG. 1B) are shifted from ±90°, and thus a signal is outputted from the ISO port. In other words, the signal S3 by the electric field coupling passes through the single parasite inductance Lp, while the signal S5 by the magnetic field coupling flows in a closed loop including a ground line and thus passes through the two parasite inductances Lp. At that time, a phase delay of the signal S5 by the magnetic field coupling is greater than a phase delay of the signal S3 by the electric field coupling, and a negative real number component occurs in the signal (S3+S5) outputted to the ISO port as shown in FIG. 6, due to the difference between the signal S3 and the signal S5. Thus, sufficient isolation and directivity cannot be ensured.

In addition, in the attenuator composite coupler described in Patent Document 1, each attenuator is a n type circuit and connected to the coupling line 22 and the ground (GND). In other words, each attenuator is ground-connected by drawing of a line and a wire. Thus, as shown in FIG. 5B, in the actually manufactured attenuator composite coupler 30L, a parasite inductance Lp is present at each of attenuators 31 and 32. Due to the parasite inductance Lp, a component having a phase shift of 90° with respect to a CPL port 35 occurs. When a component having a phase shift of 90° with respect to the CPL port 35 occurs in an ISO port 36 as described above, frequency characteristics are provided as shown in FIG. 7A. In other words, the isolation and the directivity deteriorate as compared to the frequency characteristics of the attenuator composite coupler 30 shown in FIG. 4A. When the frequency characteristics of the coupling amount and the isolation are shown in polar coordinate form, they are as shown in FIG. 7B, signals generated by magnetic field coupling and electric field coupling within the directional coupler are not completely cancelled similarly as in FIG. 6, and a negative real number component occurs in a signal outputted to the ISO port 36. Thus, sufficient isolation and directivity cannot be ensured.

Figure 8A:
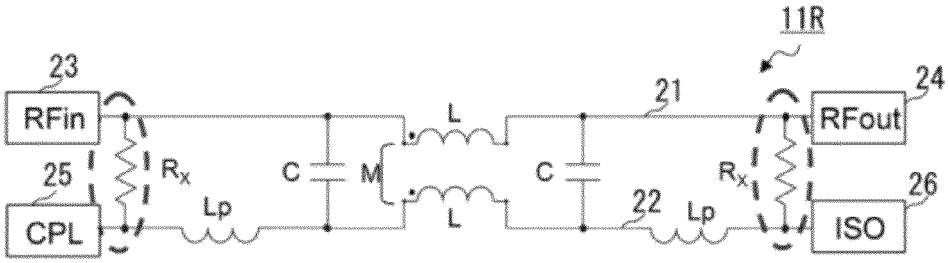
FIG. 8A is an equivalent circuit diagram of a transmission line directional coupler according to an exemplary embodiment.
Figure 8B:
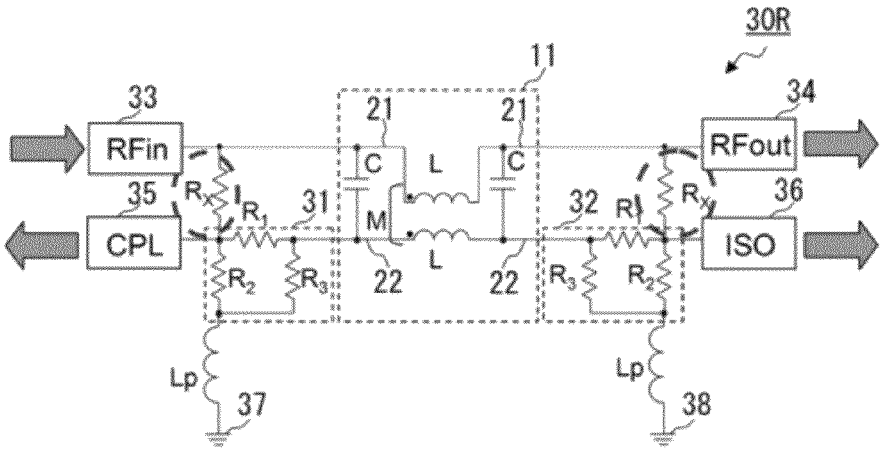
FIG. 8B is an equivalent circuit diagram of a transmission line directional coupler (attenuator composite coupler) including attenuators.
Figure 9A:
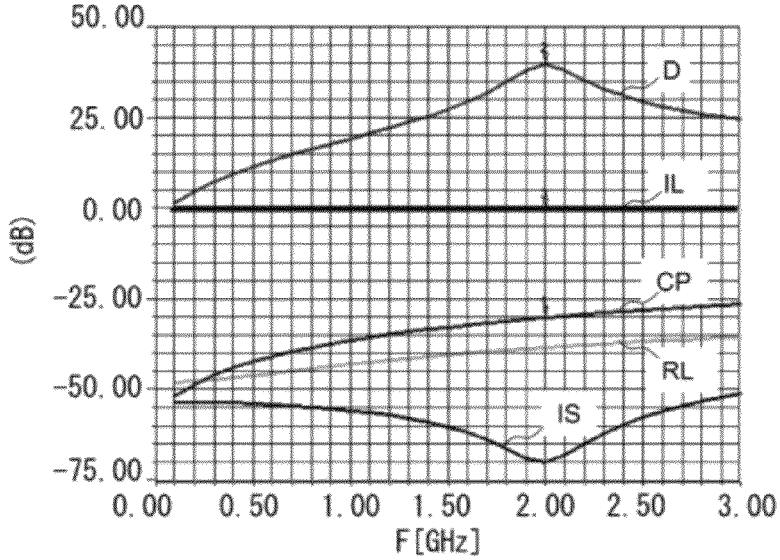
FIG. 9A is a frequency characteristic diagram of the attenuator composite coupler shown in FIG. 8B.
Figure 9B:
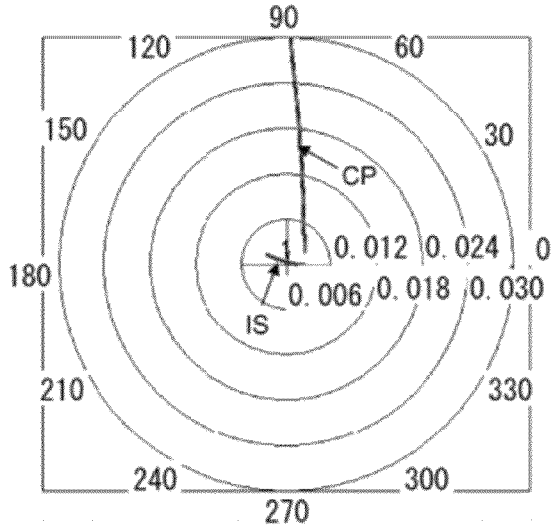
FIG. 9B is a diagram showing, in polar coordinate form, frequency characteristics of a coupling amount and an isolation of the attenuator composite coupler shown in FIG. 8B.

A schematic configuration and operation of a transmission line directional coupler according to an exemplary embodiment of the present disclosure will now be described. FIG. 8A is an equivalent circuit diagram of the transmission line directional coupler according to the exemplary embodiment. FIG. 8B is an equivalent circuit diagram of a transmission line directional coupler (attenuator composite coupler) including attenuators. FIG. 9A is a frequency characteristic diagram of the attenuator composite coupler shown in FIG. 8B. It is noted that in this figure, the same indication as in FIG. 4A is given. FIG. 9B is a diagram showing, in polar coordinate form, frequency characteristics of a coupling amount and an isolation of the attenuator composite coupler shown in FIG. 8B. In the following, the same elements as those in the related art are designated by the same reference signs and the description thereof is omitted.

As shown in FIG. 8A, the transmission line directional coupler 11R of the present embodiment includes resistive elements Rx between ports of a main line 21 and a coupling line 22, namely, between a signal input port 23 and a CPL port (coupling port) 25 and between a signal output port 24 and an ISO port (isolation port) 26.

The attenuator composite coupler 30R shown in FIG. 8B also has the same configuration and includes resistive elements Rx between a signal input port 33 and a CPL port 35 and between a signal output port 34 and an ISO port 36.

As described above, in the directional coupler 11L shown in FIG. 5A, the parasite inductances Lp are present in the coupling line 22. Thus, due to the parasite inductances Lp, a difference in phase delay occurs between a signal generated by electric field coupling and a signal generated by magnetic field coupling, and a signal having a negative real number component that cannot be cancelled even by adding both signals is outputted from the ISO port. Therefore, sufficient isolation and directivity cannot be ensured.

On the other hand, in the directional coupler 11R shown in FIG. 8A, since the resistive elements Rx are provided as described above, signals that cancel a negative real number component flow into the coupling line 22 via the resistive elements Rx, and hence the output from the ISO port 26 can be reduced and the directivity can be improved. In other words, when each resistive element Rx is adjusted to such a resistance value as to cancel a real number component of a signal that is generated at the ISO port 26 by the parasite inductance Lp present in the coupling line 22 or another circuit which is not shown and that is outputted to the ISO port 26 due to the difference in phase delay between electric field coupling and magnetic field coupling, the output (isolation) from the ISO port 26 becomes nearly zero and the directivity can be improved. Therefore, the characteristic of the directional coupler can be made favorable.

Similarly, in the attenuator composite coupler 30R shown in FIG. 8B, the output from the ISO port 36 can be reduced by adjusting the resistance value of each resistive element Rx between the terminals in accordance with a deterioration amount of the isolation by the parasite inductances Lp. In the case of the attenuator composite coupler 30R, frequency characteristics are provided as shown in FIG. 9A. In other words, the isolation and the directivity are improved as compared to the frequency characteristics of the attenuator composite coupler 30L shown in FIG. 7A. When the frequency characteristics of the coupling amount and the isolation are shown in polar coordinate form, they are as shown in FIG. 9B, and the isolation can be shifted in the positive direction of the real axis (the negative real number component can be cancelled) due to signal passage by the resistive elements Rx. Thus, the output from the isolation port becomes nearly zero and the directivity is improved.

The resistance value of each resistive element Rx suffices to be set in accordance with the characteristics of required coupling amount and isolation and the value is generally about 1 kΩ to 100 kΩ.

When the frequency characteristics of the attenuator composite coupler 30 shown in FIG. 4A, the frequency characteristics of the attenuator composite coupler 30L shown in FIG. 7A, and the frequency characteristics of the attenuator composite coupler 30R shown in FIG. 9A are compared, the following result is obtained.

TABLE

| CIRCUIT CONFIG-URATION | INSERTION LOSS (IL) [dB] | COUPLING AMOUNT (CP) [dB] | ISOLA-TION (IS) [dB] | DIRECTIVITY (D) [dB] |
|---|---|---|---|---|
| ATTENUATOR COMPOSITE COUPLIER 30 | 0.04 | 30 | 68 | 38 |
| ATTENUATOR COMPOSITE COUPLIER 30L | 0.04 | 29 | 51 | 23 |
| ATTENUATOR COMPOSITE COUPLIER 30R | 0.08 | 30 | 70 | 40 |

The above table shows the result of the comparison between the frequency characteristics. It is noted that in the table, characteristic values provided when the directional coupler is assumed to be for the 2 GHz band are indicated and are calculation values in 2 GHz.

As shown in the table, with regard to the attenuator composite coupler 30L (with the parasite inductances), the isolation (IS) is decreased by 17 dB and the directivity (D) is decreased by 15 dB as compared to the attenuator composite coupler 30 (the ideal circuit). On the other hand, with regard to the attenuator composite coupler 30R (with the parasite inductances and with the resistive elements Rx added between the ports), the isolation is improved by 19 dB and the directivity is improved by 17 dB as compared to the attenuator composite coupler 30L (with the parasite inductances). In other words, the isolation and the directivity of the attenuator composite coupler 30R are as well as those of the attenuator composite coupler 30 (the ideal circuit).

As described above, by adding the resistive elements Rx between the ports, a 90° phase-shift component with respect to the CPL port, namely, the signal outputted to the ISO port by the parasite inductances, can be cancelled at the ISO port. Thus, the output from the ISO port becomes nearly zero, the directivity is also improved, and the characteristic of the directional coupler can be improved.

Figure 10:
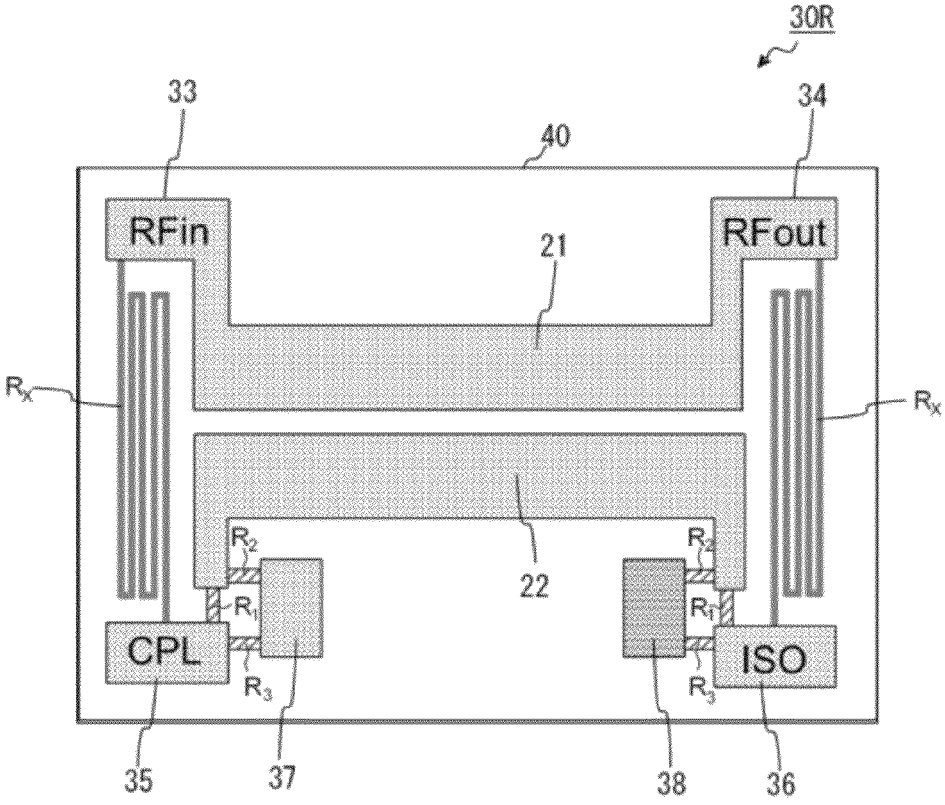
FIG. 10 is a pattern diagram of an attenuator composite coupler.
Figure 11A:
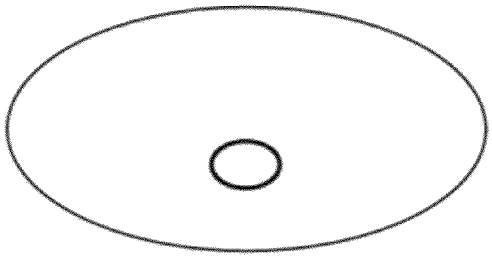
FIG. 11A is an external view of a wafer.
Figure 11B:
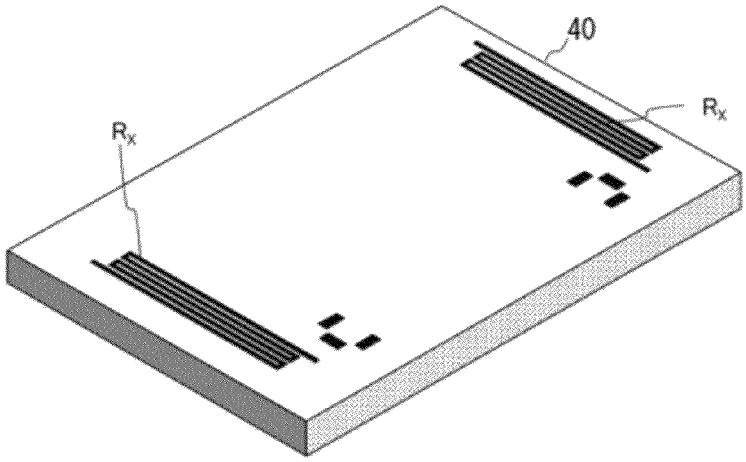
FIG. 11B is an external view of a device in which thin-film resistors are formed.
Figure 11C:
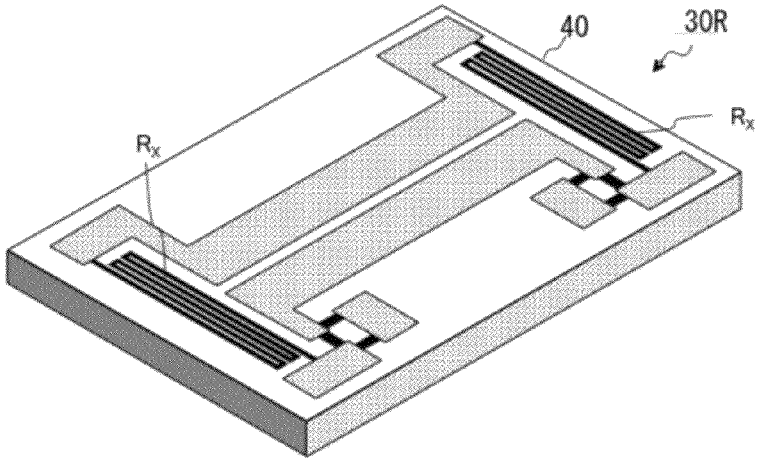
FIG. 11C is an external view of a device in which wiring electrodes are formed.

Next, an exemplary method for manufacturing the directional coupler of the present disclosure will be described with a case where the attenuator composite coupler shown in FIG. 8B is manufactured, as an example. FIG. 10 is a pattern diagram of an attenuator composite coupler. FIG. 11A is an external view of a wafer. FIG. 11B is an external view of a device in which thin-film resistors are formed. FIG. 11C is an external view of a device in which wiring electrodes are formed.

As shown in FIG. 10, the attenuator composite coupler 30R includes the main line 21, the coupling line 22, the signal input port 33, the signal output port 34, the CPL port 35, the ISO port 36, a GND port 37, and a GND port 38 on a semi-insulating substrate 40. In addition, the attenuator composite coupler 30R includes the resistive elements Rx between the signal input port 33 and the CPL port 35 and between the signal output port 34 and the ISO port 36. The attenuator composite coupler 30R includes resistors R1 between the coupling line 22 and the CPL port 35 and between the coupling line 22 and the ISO port 36, respectively. The attenuator composite coupler 30R includes resistors R2 between the coupling line 22 and the GND ports 37 and 38, respectively. The attenuator composite coupler 30R includes resistors R3 between the CPL port 35 and the GND port 37 and between the ISO port 36 and the GND port 38, respectively.

It is noted that the signal input port 33, the signal output port 34, the CPL port 35, and the ISO port 36 can be connected to another circuit via wires or the like. In addition, the GND port 37 and the GND port 38 can be connected to a ground potential via wires or the like.

The attenuator composite coupler 30R can be manufactured by the following exemplary method. As the semi-insulating substrate 40 for creating the attenuator composite coupler 30R, a wafer (substrate) on which a plurality of devices can be arranged and which is made of a material having a low dielectric loss such as GaAs (gallium arsenide) is used, as shown in FIG. 11A. In addition, the main line 21 and the coupling line 22 of the directional coupler 11 and the respective resistors R1 to R3 and Rx are formed by using a thin-film process.

When a device is manufactured by a thin-film process, silicon is generally used as a substrate material. However, a silicon substrate is a semiconductor substrate and thus has a high loss, and an insertion loss in the main line is increased when a silicon substrate is used in the directional coupler according to the present disclosure. On the other hand, when a semi-insulating substrate made of a material having a low dielectric loss such as GaAs is used, the insertion loss can be reduced.

As shown in FIG. 11B, the resistive elements Rx provided between the ports at both ends of the attenuator composite coupler 30R and the resistors R1 and the resistors R2 of the attenuators are patterned by the same thin-film process. A resistance-film pattern can be formed from, for example, a film of tantalum oxide.

In the case of the thin-film process, a resistive material such as tantalum oxide or nichrome is formed on the entire surface by vapor deposition, sputtering, plating, or the like, then a resist film is formed by a photolithographic process, and an unnecessary metal film is removed by etching. Alternatively, a pattern of a resist film can be formed by a photolithographic process, then an electrode material and a resistive material can be deposited on a portion other than the resist film pattern by vapor deposition, sputtering, plating, or the like, and at the end, a resistance-film pattern can be formed by peeling (lifting off) the resist film. According to this thin-film process, position variation of each component can be suppressed to be equal to or less than 10 μm, and thus variation of the electrical characteristic of the directional coupler is reduced to be very small. Thus, the yield of the directional coupler can be improved.

Since the attenuator composite coupler 30R includes the attenuator (resistor attenuators) 31 and 32 each composed of a plurality of resistive elements, when the resistive elements provided between the main line 21 and the coupling line 22 are formed together in a process in which the resistive elements constituting the attenuators 31 and 32 are formed, addition of a process is unnecessary and an increase in manufacturing cost can be suppressed.

Subsequently, as shown in FIG. 11C, the main line (main line 21) and the coupling line (coupling line 22) of the directional coupler and outside-drawn electrodes are formed by a thin-film process. For the main line 21 and the coupling line 22, Au or Al can be used. In addition, the outer surfaces of the main line 21, the coupling line 22, and the outside-drawn electrodes can be formed as Au films.

The coupling amount and the isolation of the directional coupler are very small signals of −30 to −60 dB with respect to an input signal. As described above, the directional coupler has a very small output characteristic, but its yield can be improved by using the high-accuracy thin-film process, as described above.

It is noted that the configuration has been described in which the resistive elements Rx are provided between the ports at both ends of the directional coupler 11R or the attenuator composite coupler 30R, but a configuration according to the disclosure is not limited thereto. In other words, as long as the parasite inductances can be cancelled or substantially canceled, it is also possible to provide the resistive element Rx at least either between the signal input port and the coupling port or between the signal output port and the isolation port.

In addition, a configuration is shown in which the attenuators are provided on both end sides of the coupling line of the directional coupler, but a configuration including attenuators according to the disclosure is not limited thereto. In other words, it can suffice to provide an attenuator at least either between the coupling port and the coupling line or between the isolation port and the coupling line.

In embodiments of the disclosed directional coupler, when a signal is inputted into the signal input port of the main line, a signal propagates in the coupling line due to electric field coupling and magnetic field coupling. In an ideal directional coupler, a signal generated by electric field coupling and a signal generated by magnetic field coupling have opposite phases and thus cancel each other, and no signal is outputted from an isolation port. On the other hand, in an actually manufactured directional coupler, a parasite inductance is present in a coupling line or a circuit connected to the coupling line, and thus a phase delay occurs in a signal generated by electric field coupling and a signal generated by magnetic field coupling, and a real number component that is not cancelled by adding both signals occurs. Therefore, sufficient isolation and directivity cannot be ensured. In contrast, embodiments of the present disclosure utilize a resistive element connected between the main line and the coupling line, and a signal that cancels the above real number component propagates to the coupling line via the resistive element. Thus, the output from the isolation port is reduced and the directivity can be improved.

The resistive element can cancel or substantially cancel a real number component of a signal that is outputted to the isolation port due to parasite inductances of the coupling line and a circuit connected to the coupling line. Because of this configuration, the output from the isolation port can be nearly zero.

In embodiments including a semi-insulating substrate on which the main line, the coupling line, and the resistive element are formed, the semi-insulating substrate has a low loss, and thus the insertion loss of the directional coupler can be reduced.

In embodiments in which the directional coupler, the main line, the coupling line, and the resistive element are formed on a semi-insulating substrate by a thin-film process, position variation of each component can be suppressed and thus variation of the electrical characteristic of the directional coupler is reduced to be very small.

In an embodiment of the directional coupler including a resistor attenuator connected at least either between the coupling port and the coupling line or between the isolation port and the coupling line, and a resistor of the resistor attenuator is formed on the semi-insulating substrate by the same process as for the resistive element, the resistive element and a plurality of resistors can be formed together, and thus addition of a process is unnecessary and manufacturing variation can be suppressed.

Accordingly, a directional coupler according to the present disclosure can provide favorable isolation characteristic and directivity, even when a parasite inductance is present in a coupling line. In addition, the insertion loss of the directional coupler can be reduced. Furthermore, the yield of the directional coupler can be improved. Moreover, an increase in manufacturing cost can be suppressed.

That which is claimed is:

1. A directional coupler comprising;

a main line connected between a signal input port and a signal output port, and a coupling line connected between a coupling port and an isolation port and coupled to the main line by electric field coupling and magnetic field coupling, wherein a resistive element is connected at least either between the signal input port and the coupling port or between the signal output port and the isolation port.

2. The directional coupler according to claim 1, wherein the resistive element cancels or substantially cancels a real number component of a signal that is outputted to the isolation port due to parasitic inductances of the coupling line and a circuit connected to the coupling line.

3. The directional coupler according to claim 1, further comprising a semi-insulating substrate on which the main line, the coupling line, and the resistive element are formed.

4. The directional coupler according to claim 2, further comprising a semi-insulating substrate on which the main line, the coupling line, and the resistive element are formed.

5. The directional coupler according to claim 3, wherein the main line, the coupling line, and the resistive element are formed on the semi-insulating substrate by a thin-film process.

6. The directional coupler according to claim 4, wherein the main line, the coupling line, and the resistive element are formed on the semi-insulating substrate by a thin-film process.

7. The directional coupler according to claim 3, wherein a resistor attenuator is connected at least either between the coupling port and the coupling line or between the isolation port and the coupling line, and a resistor of the resistor attenuator is formed on the semi-insulating substrate by the same process as for the resistive element.

8. The directional coupler according to claim 4, wherein a resistor attenuator is connected at least either between the coupling port and the coupling line or between the isolation port and the coupling line, and a resistor of the resistor attenuator is formed on the semi-insulating substrate by the same process as for the resistive element.

9. The directional coupler according to claim 5, wherein a resistor attenuator is connected at least either between the coupling port and the coupling line or between the isolation port and the coupling line, and a resistor of the resistor attenuator is formed on the semi-insulating substrate by the same process as for the resistive element.

10. The directional coupler according to claim 6, wherein a resistor attenuator is connected at least either between the coupling port and the coupling line or between the isolation port and the coupling line, and a resistor of the resistor attenuator is formed on the semi-insulating substrate by the same process as for the resistive element.

11. The directional coupler according to claim 1, wherein the resistive element is provided as a thin film resistor having a serpentine shape.

* * * * *